United States Patent [19]

Markham

[11] 4,337,902

[45] Jul. 6, 1982

[54] INSULATION ANTI-STATIC AND BLOWING MACHINE

[76] Inventor: Melvin C. Markham, Seattle, Wash.

[21] Appl. No.: 117,433

[22] Filed: Feb. 1, 1980

[51] Int. Cl.[3] ..... B02C 13/288

[52] U.S. Cl. ..... 241/56; 241/60; 241/101 A; 241/189 R; 406/48

[58] Field of Search ..... 241/56, 60, 73, 101 A, 241/101.6, 101.15, 186.2, 189 R, 41; 406/47, 48

[56] References Cited

U.S. PATENT DOCUMENTS

| | | | |
|---|---|---|---|
| 1,960,346 | 5/1934 | Myers | 241/56 |
| 2,081,552 | 5/1937 | Myers | 406/47 X |
| 2,550,354 | 4/1951 | Jacobsen | 241/101 A |
| 3,037,712 | 6/1952 | Hosokawa et al. | 241/56 |
| 3,061,206 | 10/1962 | Matter | 241/101 A X |
| 4,151,962 | 5/1979 | Calhoun et al. | 241/101 A |

*Primary Examiner*—Mark Rosenbaum

*Attorney, Agent, or Firm*—Cole, Jensen & Puntigam

[57] ABSTRACT

A machine for fluffing fiberglass insulation at a faster rate than heretofore possible, introducing an antistatic material and blowing the material to a point of installation a greater distance from the machine than heretofore possible. In addition to fluffing the insulation to assure the necessary insulative qualities, the fiberglass material must also be treated with an anti-static solution to make it capable of appropriate placement and to reduce the dust and flyaway prevalent with this type of operation.

4 Claims, 4 Drawing Figures

INSULATION ANTI-STATIC AND BLOWING MACHINE

BACKGROUND OF THE INVENTION

With the ongoing shortage of fuels and the greater emphasis upon fuel efficient buildings, the business of and demand for insulating a home and/or buildings have grown rapidly. It is well known that paper products are being recycled by treating them with chemicals to repel rodents and to retard fire, and then using the pump-like end product for insulation. These recycled paper products when applied are generally fed through a blower such that they become more fluffy, retain more insulative air and are able to be applied at a point distant from the supply.

A similar process is often used for fiberglass. Fiberglass insulation may be utilized in bolts or rolls, or alternatively supplied in bulk and placed in position loose through some mechanized process. As is well known, the handling of fiberglass, regardless of the particular packaging means, is an unpleasant job. It is therefore desirable to have the fiberglass placed in position in as little time as possible and yet have the fiberglass as fluffy as possible. The rapid placement is desirable in that it minimizes operator exposure to the dust and particles, and further reduces cost to the consumer.

It is desirable to utilize fiberglass in many forms, including fiberglass which is scraped or is overage from other areas of application, such as airplane manufacture, if this material may be economically converted for use in homes, buildings, or the like.

It is with this end in mind that the present invention contemplates taking fiberglass, no matter how tightly compacted, passing it through a hammer mill or beater, and then treating it with an anti-static material and blowing it into the appropriate and necessary position in a house or other building.

It is an object of the present invention to provide a machine which will fluff fiberglass insulation and discharge it with sufficient force to carry it to a point of application a substantial distance from the location of the machine.

It is another object of the present invention to provide a machine which operates at a greater speed than heretofore known and has an impeller driven by the same motor as the fluffer such that the fiberglass is quickly passed through the fluffer and the impeller, thus allowing the job to be completed in far less time.

It is still a further object of the present invention to provide an impeller mechanism and enclosing apparatus for blowing fiberglass which includes as an integral part thereof means for controlling the application of and for placing anti-static material upon the fluffed fiberglass in a uniform manner.

Still a further object of the present invention is to provide a means whereby an anti-static liquid is impinged upon the end of the rapidly rotating shaft of an impeller such that the anti-static material is evenly distributed throughout any fiberglass insulation which passes thereby.

DETAILED DESCRIPTION OF THE DRAWINGS

Figure 1:
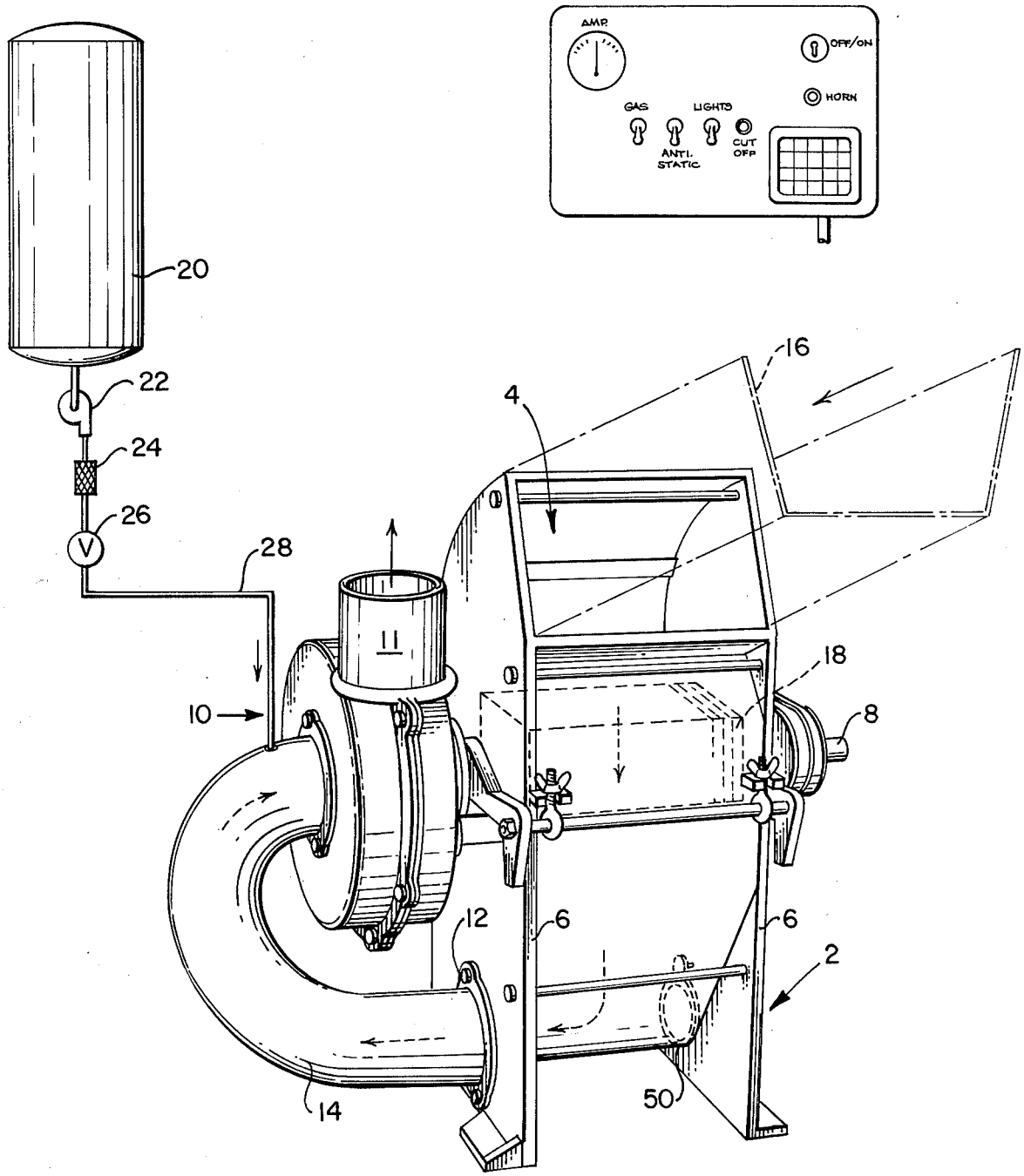
FIG. 1 is a pictorial representation of the present inventive insulation fluffer and blower, with an inset view of the control panel.

As seen in FIG. 1, the present invention incorporates as an integral portion thereof elements of the standard hammer mill, including an exterior containing framework and enclosure generally designated 2 having an opening 4 in the upper front portion thereof to receive material (as explained hereinafter), and a pair of opposed side members 6 having coaxial openings therethrough to allow passage of a rotatable shaft 8 which drives an impeller 10. A second opening 12 is located at the bottom of the framework 2 beneath the impeller 10 to permit securement of a tube or conduit 14 which controls the flow of material which has passed through the hammer mill and feeds it to the impeller 10 to be discharged through discharge tube 11 to which will be attached a flexible conduit (not shown) which is utilized in transferring the insulation to the point of application. The rotation of the hammers within the enclosure 2 in conjunction with the airflow generated by the impeller 10 assures a constant flow of material through the mechanism to be discharged at the appropriate location.

The hammer mill, which will be noted in greater detail hereinafter, has been modified such that it can be used for the purpose of expanding and treating insulative material at a fast rate. With this end purpose in mind, the mechanism includes a hopper-type structure 16 (shown in phantom) which is removably mounted to the opening 4 such that a greater quantity of material may be placed in readiness and proper position for movement through the hammer mill. Also seen in this view in phantom lines are the hammers 18 which are rapidly rotated about shaft 8 to break apart any compacted insulation and fluff all of the material.

A pressurized tank 20 is used to store the anti-static solution, which will be applied to the material at a predetermined desired rate. The anti-static solution passes through a pump 22, filter 24, a metering valve 26, and then through conduit 28 to a point of intersection with the conduit 14 through which the insulation is being forced for interaction with the impeller for uniform distribution throughout the insulation, as explained in detail hereinafter.

Also as seen in this view, is the control panel, which will, because of the particular modifications of the machine and the rate at which the machine is operating, be placed at a point somewhat distant from the machine itself so remote control is available in the event of an emergency. As seen in this view, the control panel includes a master control switch for turning the machine on and off, a signaling device, such as a horn, to communicate with the person doing the installation, an emergency cutoff, a switch for lights at the point of installation or at the site of the machine, a switch for controlling the addition of anti-static material, and an emergency control switch for the gasoline for the gas-powered engine. It is to be understood that the specific controls shown and described are for illustrative and safety purposes only and are not considered critical to the invention in the manner shown.

Figure 2:
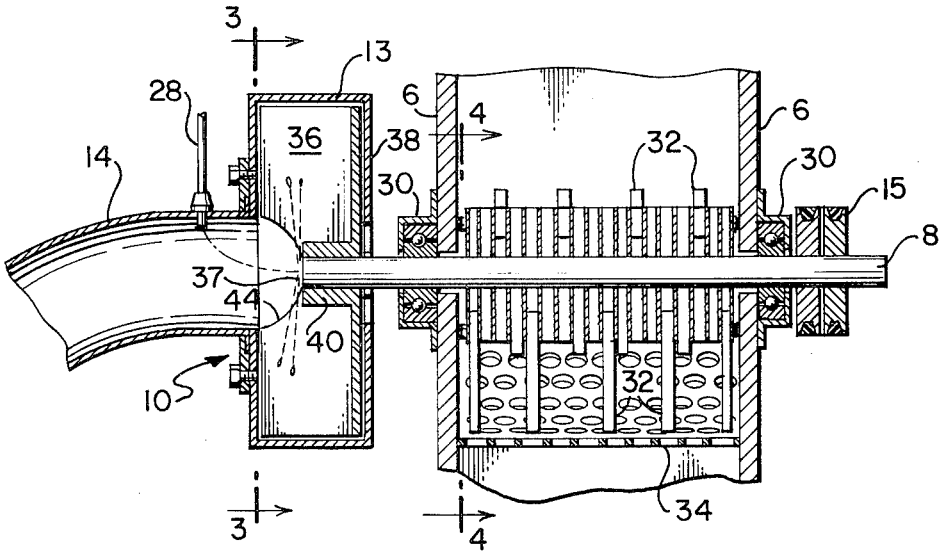
FIG. 2 is a vertical sectional view showing the interior of the hammer mill, which does the fluffing, and the impeller in conjunction with the anti-static supplier.

Referring now to FIG. 2, it can be seen that the pair of opposing side walls 6 having passing therethrough a shaft 8 which, when in operation, is driven by pulleys 15. Pulleys 15 would be driven in a normal fashion by V-belts (not shown) which extend to a gasoline driven engine which is preferably about 16 horsepower. The driveshaft 8 for the hammer mill and the impeller is driven, because of the pulley combination, at approximately 9700 RMP's, or approximately three times the preferred running speed of the gasoline engine.

To accommodate the speed at which the shaft 8 and the mechanism secured thereto rotate, special high-speed bearings 30, which are lubricated at frequent intervals with a lubricant formulated to withstand the speed and temperature, are installed. The hammer blades from the commercial hammer mill are sharpened and heat treated to take the increased speed of rotation and thus the greater and more frequent impact. For obvious reasons, the shaft and elements secured thereto are carefully balanced before startup. As seen in this view, the hammers 32, which are part of the purchased mechanism, are secured to the shaft 8 by means of a plurality of spacers which control rotational movement of the hammers, as explained in greater detail hereinafter. Located generally beneath hammers 32, and enabling them to operate effectively, is a screen 34. The screen 34, which is approximately semicircular in cross section (see FIG. 4), assures that the insulation is properly fluffed before passing downwardly and thus outwardly to the impeller. The insulation, having been fed into the machine, is moved by a combination of gravity and agitation by the hammers to a position generally overlying the screen 34. As the hammers 32 rotate, they contact and beat the insulation, forcing it to pass downwardly in a fluffed condition through the screen 34.

The fluffed insulation, having passed through screen 34, falls to the bottom of the mill and is then drawn by conduit 14 out of the mill and upwardly to the impeller, which is located within the housing 13. Keeping in mind the rate of rotation, it is important to note that the impeller includes polished and carefully balanced blades 36 which are held in position by a backing and supporting plate 38 which is in turn secured to a hub 40 which is keyed to shaft 8 and driven thereby.

Conduit 28, which leads from the anti-static supply tank (see FIG. 1), intersects and penetrates conduit 14 adjacent the impeller. The anti-static material, when the unit is in operation, is conducted into the interior of the conduit 14 through the conduit 28. Conduit 28 terminates, in the embodiment shown, at a point just inside of conduit 14. The anti-static fluid, which may be water, is carried into the housing 13 by the movement of air through conduit 14 and impinges upon the outer end 37 of shaft 8 in a trajectory shown in FIG. 2. The anti-static liquid splatters when it hits the end of rapidly rotating shaft 8, and flows radially outwardly onto blades 36 in the impeller. The fluid is evenly distributed throughout the insulation which passes the blades 36. The treated insulation is then propelled through discharge tube 11 to the point of installation. It is important to note that the rate at which the anti-static fluid enters conduit 14, in conjunction with the speed of the rotation of the impeller and the flow of insulation and air thereby, control the trajectory of the anti-static fluid, assuring that it contacts the shaft 8 at the appropriate point and is mixed with the insulation at an appropriate rate.

Figure 3:
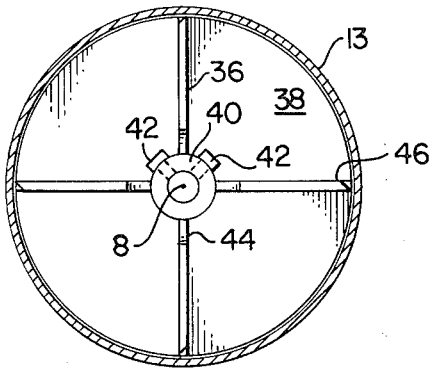
FIG. 3 is a vertical sectional view taken along lines 3—3 of FIG. 2.

Referring now to FIG. 3, the impeller blades can be seen. The hub 40, which is secured to shaft 8, includes a pair of locking bolts 42 to assure securement and stable positioning during the rapid rotation during operation. The impeller blades 36 include an arcuate cutout portion 44 (see FIG. 2) around the hub to permit the insulation and anti-static fluid to flow inwardly, impinge upon the shaft 8, and then be carried outwardly onto the blades themselves where it will be absorbed by the passing insulation. The backing plate 38 is slightly smaller than the housing 10 for rotation therein without interference from insulation thrown outwardly. As seen in this view, the outer portions of the blades 36 are sharpened as at 46 to greatly lessen the possibility of jamming should too much insulation appear at the impeller at a given time. The sharpened blade at its rate of rotation will cut through excess material.

Figure 4:
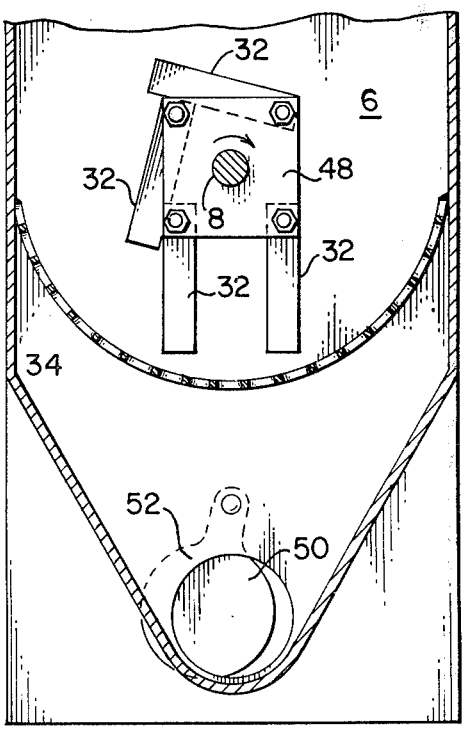
FIG. 4 is a vertical sectional view taken along lines 4—4 of FIG. 2.

Referring now to FIG. 4, the hammer portion of the mill can be seen. The hammer comprises a plurality of hammer blades 32 mounted between plates 48 which are in turn secured to shaft 8 and rotate therewith. The relative location of the individual hammers limits their arcuate movement. As can be seen, the screen 34 underlies the hammers and assures the uniform or even passage of the insulation downwardly to be drawn to the impeller.

To insure an adequate and unfirom flow of air through the hammer mill, so that insulation may be delivered to a remote location at a uniform rate, an opening 50 is provided in the one side member 6 which is opposed to the side member which contains the opening 12 for tube 14. As seen most clearly in FIG. 4, opening 50 is located, in the embodiment shown, substantially intermediate between the side edges of the side member, and beneath screen 34. In the embodiment shown, the opening 50 is circular, approximately 3 inches in diameter.

A plate 52 is rotatably secured, by means of a bolt and wing nut, or the like, to the side member 6 at such a point that the plate can be conveniently rotated to cover all or a selected portion of the opening 50.

In operation, the position of the plate relative to the opening helps determine the operating condition of the machine. When the opening 50 is fully open, insulation can be delivered a substantial distance, i.e. more than 50 feet. For normal delivery distances, i.e. 10–15 feet, the plate is positioned so that there is an approximately $\frac{3}{4}$ inch space between the edge of the plate 52 and the edge of the opening. It has been found that varying the size of the opening not only increases the delivery distance capability of the machine, but also is important in maintaining a uniform flow of insulation at the delivery point.

With the opening 50, the machine can also be utilized as a vacuum, to permit rapid cleanup of an insulation installation operation for instance, or for other similar cleanup work. In the vacuum mode, a hose is secured in the opening 50, and a collection bag is placed over the discharge tube 11. When the machine is actuated, material is sucked into the machine through the hose and opening 50, through the bottom portion of the hammer mill beneath screen 34, through conduit 14 and impeller 10, to the discharge tube 11 and the collection bag. Hence, the embodiment of the invention shown and described is a multi-purpose machine, capable of installing insulation rapidly and uniformly at delivery points of varying distance from the machine, and also capable of rapid cleanup after the installation has been completed.

The present invention thus provides a novel means for handling bulk fiberglass insulation, making it useful for insulation in residences and the like, assuring rapid installation of the insulation, and in the process, fluffing the insulation to further improve its insulative qualities. Further, the mechanism includes means for adding an anti-static material, which is typically a liquid of some kind, usually water, so that the insulation is delivered to the desired location at the appropriate consistency and tends to remain in position once delivered.

What is claimed is:

1. An apparatus for fluffing, treating and blowing insulation, comprising:

hopper means to receive and temporarily store insulation;

hammer mill means to beat the insulation until it is fluffed;

blower means for moving the insulation from said hammer mill means through a conduit means to said blower means and from there to a remote location, said blower means including impeller means which comprises a shaft and a plurality of impeller blades extending outwardly therefrom; and means introducing anti-static liquid into said conduit means, at such a position relative to said blower means and at such a rate and with such a trajectory relative to the airflow through said conduit means resulting from the operation of said blower means that the anti-static liquid impinges upon an exposed end of the rapidly turning shaft of said impeller means in said blower means, wherein the anti-static liquid, upon contact with the rapidly turning shaft, is splattered throughout the insulation within said blower means.

2. The apparatus of claim 1, wherein said impeller means includes an impeller housing, said impeller housing said hammer mill means, and said conduit means have interior surfaces wherein the interior surfaces of said impeller housing, said hammer mill means, and said conduit means are polished, and wherein said impeller blades are highly sharpened, balanced and heat treated, to withstand a speed of rotation significantly greater than normal.

3. The apparatus of claim 1, wherein said hammer mill means and said blower means are driven by a single shaft from a common power means.

4. The apparatus of claim 3, including drive means interfacing said power means with said single shaft in such a manner that the rate of rotation of said single shaft is significantly greater than the rate of rotation of said common power means, so that said hammer mill means and said blower means are driven at an exceptionally high speed.

* * * * *